United States Patent [19]

Troncoso et al.

[11] Patent Number: 4,825,576

[45] Date of Patent: May 2, 1989

[54] DETACHABLE GUN TRIGGER SAFETY DEVICE

[76] Inventors: Robert Troncoso; Fernando Troncoso, Jr., both of 14090- 6100 Rd., Montrose, Colo. 81401

[21] Appl. No.: 177,391

[22] Filed: Apr. 4, 1988

[51] Int. Cl.[4] ..... F41C 17/02

[52] U.S. Cl. ..... 42/70.07

[58] Field of Search ..... 42/70.06, 70.07

[56] References Cited

U.S. PATENT DOCUMENTS

| | | | |
|---|---|---|---|
| 2,948,978 | 8/1960 | Salverda | 42/70.07 |
| 2,978,826 | 4/1961 | Ivy | 42/70.06 |
| 3,711,979 | 1/1973 | Small | 42/70.07 |
| 3,732,641 | 5/1973 | Adajian | 42/70.07 |
| 3,861,069 | 1/1975 | Heurlen | 42/70.07 |
| 4,723,370 | 2/1988 | Sheehan | 42/70.07 |

FOREIGN PATENT DOCUMENTS

| | | | |
|---|---|---|---|
| 100975 | 8/1923 | Switzerland | 42/70.07 |

OTHER PUBLICATIONS

"What's New", *Guns & Ammo.*, Aug. 1987, p. 62.

*Primary Examiner*—Deborah L. Kyle
*Assistant Examiner*—Richard Klein
*Attorney, Agent, or Firm*—Donald E. Nist

[57] ABSTRACT

In one embodiment, the detachable gun trigger safety device includes a threaded bolt assembly having a longitudinally extending threaded shank and a curved bolt head adapted to receive a portion of the rear housing of a gun trigger guard. The device also includes a mating lock nut threadably received on that shaft and having a front surface adapted to bear against the rear of a gun trigger. The front surface of the nut includes a groove adapted to receive the rearwardmost curved surface of the trigger. The device is designed to span the space between a gun trigger and the rear portion of that gun's trigger guard and wedge the trigger forward to prevent its rearward movement and firing of the gun. The lock nut may include a number of spaced protrusions in its front surface to help resist turning of the nut when tight against the trigger. The nut may be knurled to facilitate turning on the shaft and the shaft may have one or more cotter pins holes transversely therethrough. The bolt head may have a curved central groove flanked by side flanges to assist in seating and retaining the bolt against the rear portion of the gun trigger guard. In another embodiment, the device may be a notched rubber ball, with or without an expansion bolt, or a two-piece expandable slip box.

4 Claims, 1 Drawing Sheet

DETACHABLE GUN TRIGGER SAFETY DEVICE

PRIOR ART STATEMENT

The subject matter of the present invention has not been searched to determine any relevant prior art. Applicant knows of no such relevant prior art and accordingly believes that the present invention is patentable.

BACKGROUND OF THE INVENTION

1. Field of the Invention

The present invention generally relates to safety devices and more particularly to such a device for a gun trigger.

2. Prior Art

Safety devices to prevent the inadvertant firing of handguns, rifles, shotguns and the like have been devised and are in use. In many instances the devices are expensive, difficult to install, difficult to remove, cumbersome and unattractive. One such device fits around the gun trigger housing to wholly or partially enclose it and block all access to the trigger. That device employs a lock and key. Loss of the key or lack of lighting can seriously impair the ability of the owner to gain use of the gun, as in an emergency. Another such device employs a threaded plastic rod which is pushed into the gun barrel and is screwed into a female receptacle inserted into the gun breech or revolving cylinder. That device is complicated, difficult to manufacture, expensive and tedious to install. It also renders the gun incapable of use for an extended period until the rod and receptacle are removed therefrom.

There remains a need for a simple, inexpensive, childproof gun safety device which can be quickly installed and as quickly removed to provide access to the gun trigger and use of the gun.

Such device should be easy to manufacture and be capable of being formed in various sizes and shapes to meet the requirements of various guns.

SUMMARY OF THE INVENTION

The improved detachable gun trigger safety device of the present invention satisfies all the foregoing needs. The device is substantially as set forth in the Abstract of the Disclosure. Thus, in one embodiment the device comprises a threaded bolt assembly having a longitudinally extending threaded shank and a curved volt head, the latter adapted to receive a portion of the rear housing of a gun trigger guard. The bolt assembly can be made of metal, plastic or the like, as can the other portion of the device which is a mating lock nut threadably received on the bolt shaft and having a front surface adapted to bear against the rear end of a gun trigger.

The device is designed to span the space between the gun trigger rear end and the rear portion of the gun trigger guard, wedging the trigger forward so that it cannot be pulled back to fire the gun. The lock nut may include a number of protrusions spaced around its front surface and projecting forwardly thereon. These are designed to help resist turning of the nut to loosen it once it has been tightened against the rear of the gun trigger. The nut may also be knurled at its periphery to facilitate turning it. The front face of the nut may have a circular dish-shaped depression to receive the curved rearwardmost portion of the trigger. Similarly, the bolt head as a curved central groove flanked by side flanges to assist in seating and retaining the bolt head against the rear portion of the trigger guard. In another embodiment the device is a notched rubber ball with or without an expansion-compression bolt therein. In a third embodiment, the device is a telescoping slipbox. All embodiments perform similarly.

Various other features are set forth in the following detailed description and accompanying drawings.

DRAWINGS

DETAILED DESCRIPTION

FIGS. 1–5

Figure 1:
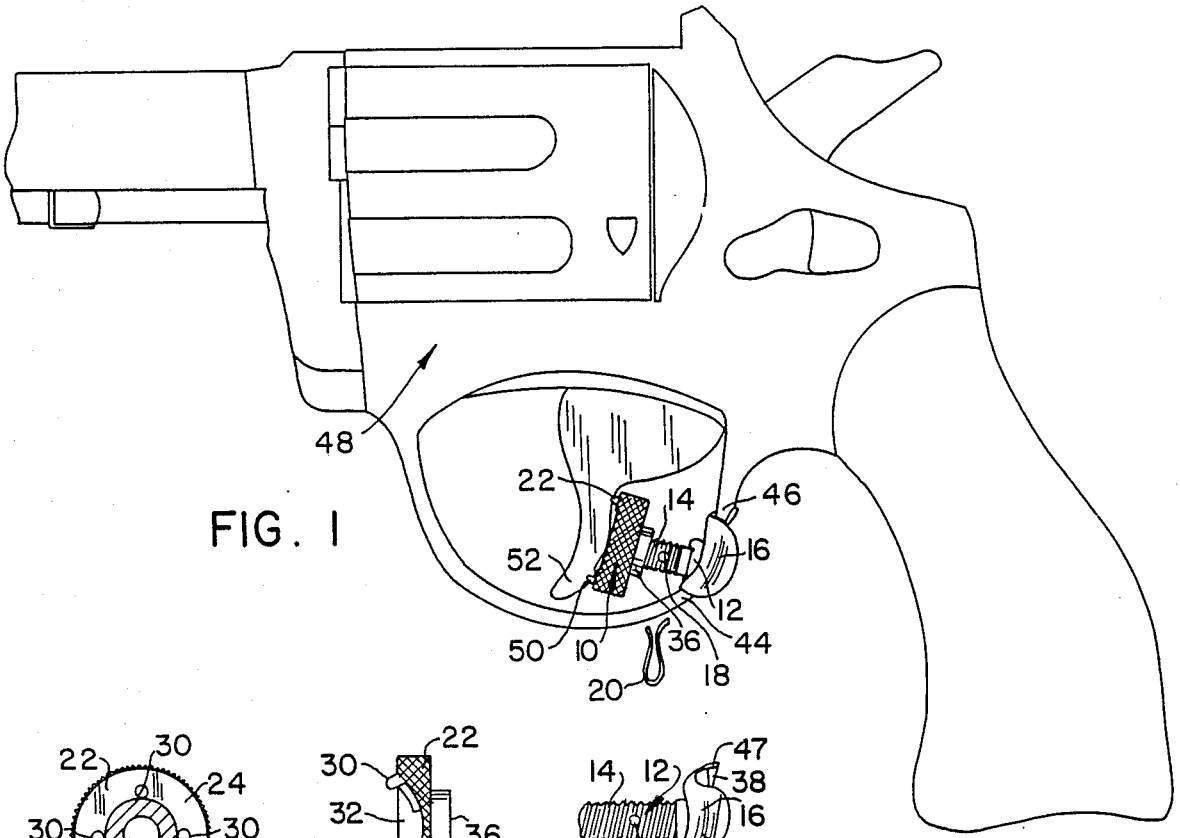
FIG. 1 is a schematic side elevation, partly broken away, of a first preferred embodiment of the improved gun safety device of the present invention installed on a revolver.
Figure 2:
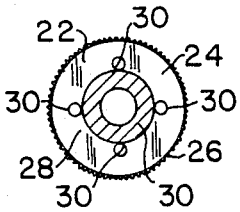
FIG. 2 is a schematic front elevation of the nut portion of the device of FIG. 1.
Figure 3:
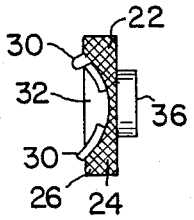
FIG. 3 is a schematic side elevation of the nut of FIG. 2.
Figure 4:
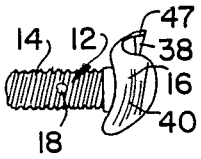
FIG. 4 is a schematic side elevation of the bolt portion of the device of FIG. 1.

Now referring more particularly to the drawings, a first preferred embodiment of the improved detachable gun trigger safety device of the present invention is schematically depicted therein. Thus, device 10 is shown which comprises a bolt 12 having an elongated longitudinally extending threaded shaft 14 and a curved bolt head 16. Shaft 14 may have one or more cotter pin holes 18 or like extending transversely therethrough, for insertion of a cotter pin 20 therethrough, which may form part of device 10. A strategically placed cotter pin 20 can prevent lock nut 22, which forms part of device 10 and which is threadably received on shaft 14, from being screwd towards bolt head 16, for purposes as set forth below.

Lock nut 22 includes a disc portion 24 having a knurled outer periphery 26 and a front face 28 with spaced integral protrusions 30 projecting forwardly thereof and a disc-shaped depression 32 surrounding the central opening 34 through which shaft 14 is received. The rear end of disc 24 is integral with reduced neck 36, also containing opening 34.

Figure 5:
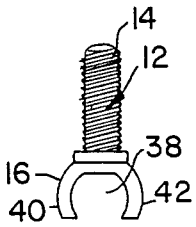
FIG. 5 is a schematic top plan view of the bolt of FIG. 4.

Head 16 of bolt 12 has a central depression or groove 38 surrounded or flanked by a pair of side flanges 40 and 42. Preferably, head 16 has a continuous curvature, as shown in FIG. 5. Head 16 is able to easily seat and hold against the curved rear portion 44 of trigger guard 46 of gun 48, as shown in FIG. 1, while shaft 14 extends towards toward the rear end 50 of gun trigger 52. Nut 22 is threaded on shaft 14 and is adapted to be screwed into tight contact with end 50, as shown in FIG. 1, biasing trigger 52 forward preventing it from firing gun 48. The curved rearwardmost portion of end 50 seats within depression 32, helping to properly align nut 22.

Protrusions 30 bear against the rear end 50 of trigger 52 at spaced points along the curvature of end 50, as shown in FIG. 1 helping to provide a locking effect, resisting unscrewing of nut from end 50. Because of the flanges 40 and 42, nut 22 must be unscrewed a considerable distance before device 10 can be removed from gun 48. Cotter pin 20 when in hole 18 prevents this from happening, so that an intentional effort to pull pin 20 must be carried out in order for the stripping of device 10 from gun 48 to be able to proceed. Thus, this is a tamper-proof child safety feature of the invention. A child playing with the device 10 will not be able to remove it from gun 48 so that trigger 52 still cannot be pulled back far enough to fire gun 48.

When it is desired to insert device 10 in guard 46, nut 22 is threaded onto shaft 14 towards head 16, with pin 20 absent from hole 18, a sufficient distance to allow such insertion. Head 16 is then fitted around end 44 of guard 46. Thereafter nut 22 is screwed toward trigger 52 until front end (face) 28 is tightly there against, biasing trigger 52, holding device 10 in place in guard 46.

FIG. 6

Figure 6:
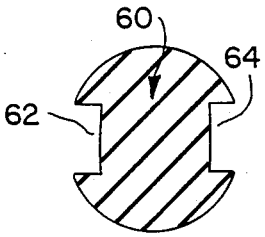
FIG. 6 is a schematic side elevation of a second preferred embodiment of the improved safety device of the present invention.

A second preferred embodiment of the improved safety device of the present invention is schematically depicted in FIG. 6. Thus, device 60 is shown which comprises an elastomeric ball of synthetic rubber or plastic notched at opposite ends 62 and 64 to accept, respectively, the rear end of gun trigger 52 and the rear portion 44 of trigger guard 46. Thus, ball 60 is wedged in place to accomplish the desired trigger-blocking function.

FIG. 7

Figure 7:
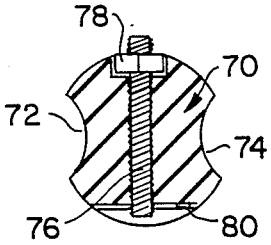
FIG. 7 is a schematic vertical cross section of a third preferred embodiment of the improved safety device of the present invention.

A third preferred embodiment of the improved safety device of the present invention is schematically depicted in FIG. 7. Thus device 70 is shown which comprises an elastomatic ball identical to device 60 except it is dished rather than notched at apposite ends 72 and 74. Moreover, it includes a bolt 76 bearing a nut 78 on one end thereof and a pressure plate 80 on the opposite end thereof. When nut 78 is tightened on bolt 76, it compresses ball 70 transversely against plate 80 causing it to tend to elongate towards ends 72 and 74, thus more tightly compressing it against trigger 52 when substituted for device 10 or gun 48.

Figure 8:
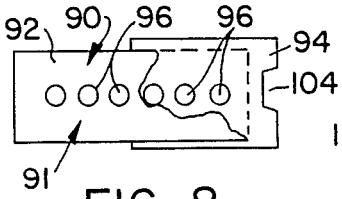
FIG. 8 is a schematic side elevation, partly broken away, of a fourth preferred embodiment of the improved safety device of the present invention; and, FIG. 9 is a schematic top plan view of the device of FIG. 8.
Figure 9:
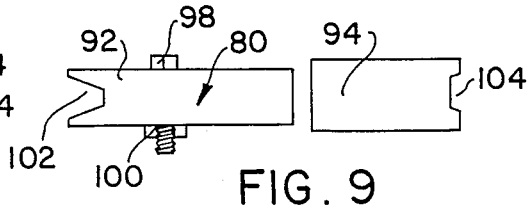

FIGS. 8 and 9

A fourth preferred embodiment of the improved safety device is schematically depicted in FIGS. 8 and 9. Thus device 90 is shown which comprises a box 91 having two telescoping hollow parts 92 and 94. Parts 92 and 94 each bear a plurality, of longitudinally spaced transverse openings 96 extending therethrough. A cross bolt 98 (FIG. 9) with nut 100 may be used to pass through aligned openings 96 in parts 92 and 94 and releasably lock them together in any desired position.

Part 92 is notched at eadn 102 to releasably seat the rear end of trigger 52 while part 94 is notched at end 104 to releasably seat the rear portion 44 of guard 46. Device 90 may be substituted for devices 10, 60 and 70 in gun 48.

Accordingly a simple safety device, easily manufactured of metal, plastic, ceramic or the like is provided, which device is inexpensive, durable and efficient. In device 10, shaft 14 can be trimmed to meet the requirements of the trigger guard of whatever gun it is to be used with. The size and shape of head 16, nut 22, etc. can also be changed, as desired. Similar changes can be in devices 60, 70 and 90.

Various other modifications, changes, alterations and additions can be made in the improved device of the present invention, its components and parameters. All such changes, modifications, alterations and additions as are within the scope of the appended claims form part of the present invention.

What is claimed is:

1. An improved detachable gun trigger safety device, said devise comprising, in combination:

a. a threaded bolt assembly having
   i. a longitudinally extending threaded shaft, and
   ii. a curved bolt head adapted to receive a portion of the rear housing of a gun trigger guard; and b. a mating lock nut threadably received on said shaft of said bolt and having a front surface adapted to bear against the rear of a gun trigger, said front surface bearing a groove adapted to receive the curved rear portion of said gun trigger, said lock nut being knurled at its outer periphery to facilitate turning of said nut on said shaft, said lock nut defining a central threaded opening passing from the front to the rear end thereof through which said shaft passes, said shaft having at least one opening transversely therethrough for insertion of a cotter pin therein to inhibit removal of said device from a gun trigger, said cotter pin being included with and forming part of said device; said device being adapted to releasably span the space between a gun trigger and the rear portion of the gun's trigger guard, thus preventing the rearward movement of that trigger and firing of that gun.

2. The improved safety device of claim 1 wherein said lock nut front surface bears a plurality of spaced protrusions adapted to resist turning of said nut when tight against the rear of a gun trigger.

3. The improved safety device of claim 1 wherein said bolt head includes a curved central groove flanked by rearwardly extending side flanges adapted to seat and hold the rear portion of a gun trigger guard.

4. The improved safety device of claim 1 wherein the head of said bolt is crescent shaped in top plan view and wherein said bolt and lock nut are metal.

* * * * *